US008669454B1

(12) United States Patent
Lin

(10) Patent No.: US 8,669,454 B1
(45) Date of Patent: Mar. 11, 2014

(54) FOLDABLE MUSICAL INSTRUMENT PEDAL DEVICE

(71) Applicant: E Bin Industrial Co., Ltd., Taichung (TW)

(72) Inventor: Hsi-Tan Lin, Taichung (TW)

(73) Assignee: E Bin Industrial Co., Ltd., Taichung (TW)

( * ) Notice: Subject to any disclaimer, the term of this patent is extended or adjusted under 35 U.S.C. 154(b) by 0 days.

(21) Appl. No.: 13/776,928

(22) Filed: Feb. 26, 2013

(51) Int. Cl.
*G10D 13/02* (2006.01)

(52) U.S. Cl.
USPC ..... 84/422.1

(58) Field of Classification Search
USPC ..... 84/422.1, 422.3
See application file for complete search history.

(56) References Cited

U.S. PATENT DOCUMENTS

| | | | | |
|---|---|---|---|---|
| 6,822,150 | B1 | 11/2004 | Lombardi | |
| 7,511,212 | B1 | 3/2009 | Chang | |
| 2008/0173159 | A1* | 7/2008 | Chen | 84/422.1 |

* cited by examiner

*Primary Examiner* — Kimberly Lockett
(74) *Attorney, Agent, or Firm* — Wang Law Firm, Inc.; Li K. Wang; Stephen Hsu

(57) ABSTRACT

A foldable musical instrument pedal device having a positioning element hung at a base board. The positioning element is drooped when the base board stays in air, and a first stop portion is swung downwardly with a support frame and across a second stop portion from an external side of the base board to an internal side of the base board. When the base board is placed on a ground, each second stop portion is propped out from the base board to block the first stop portion in an upward swinging direction of the support frame, so as to fix the support frame to the fixed base.

5 Claims, 13 Drawing Sheets

FOLDABLE MUSICAL INSTRUMENT PEDAL DEVICE

BACKGROUND OF THE INVENTION

1. Field of the Invention

The present invention relates to a musical instrument component, and more particularly to a foldable musical instrument pedal device.

2. Description of the Related Art

With reference to R.O.C. Utility Model No. M267585 for a "foldable musical instrument pedal mechanism", the mechanism as shown in FIGS. 1 and 2 comprises a fixed element (211, 221) of a pedal base (2), and a movable element (212, 222) is pivotally coupled to a fixed base (1) to achieve the effect of reducing the volume effectively after a musical instrument pedal is folded. However, the fixed element (211, 221) and the pedal base (2) are fixed by a fixing bolt (15), so that when a musical instrument is used and the pedal (20) is stepped repeatedly for a number of times, vibrations produced by the stepping may loosen the bolt easily and give rise to an unsecured fixation between the pedal base (2) and the fixed base (1).

With reference to R.O.C. Utility Model No. M331162 for a musical instrument support frame structure with a foldable pedal, the structure as shown in FIGS. 1 and 2 comprises a side frame (21) with a slide rod (22), and the side frame (21) is pivotally coupled to a support rod (14), wherein a protrusion (211A) of the side frame and a recession (141) of the support rod (14) have teeth, and a first locking element (25) is provided for the purposes of locking and positioning when the side frame (21) and the support rod (14) are coupled. However, although the structure of the support frame has the protrusion (211A) and the recession (141) engaged with one and other by the teeth, yet when the pedal (23) is stepped frequently, the first locking element may be loosened easily, so that the protrusion (211A) and the recession (141) are separated from each other to result in the same problems of the aforementioned utility model, and the teeth structure of the protrusion (211A) and the recession (141) require molding and incur a higher manufacturing cost.

Therefore, it is a main subject of the present invention to overcome the aforementioned problems of the conventional foldable musical instrument pedal device.

SUMMARY OF THE INVENTION

In view of the problems of the prior art, it is a primary objective of the present invention to overcome the problems by providing a foldable musical instrument pedal device, and the device comprises a positioning element installed at a base board of a fixed base, such that when a support frame of a pedal base swings downwardly to position the fixed base securely, the issue of loosening the support frame and the fixed base caused by the stepping of a pedal can be overcome, and the positioning element comes with a simple structure that can lower the manufacturing cost effectively.

To achieve the aforementioned objective, the present invention provides a foldable musical instrument pedal device, comprising:

a fixed base, having a base board transversally disposed at the bottom of the fixed base, and two upright pillars fixed on both sides of the base board respectively;

a pedal base, having two support frames corresponding to the two upright pillars, and each support frame having a horizontal section with a substantially equal height with the base board, and a vertical section formed by perpendicularly bending an end of the horizontal section, and a top end of the vertical section at a height position being directly and pivotally installed at the corresponding upright pillar, and at least one first stop portion being disposed at a bent corner of the horizontal section and the vertical section;

a pedal, installed between the two support frames, and an end of the pedal away from the fixed base being pivotally installed to the pedal base, and an end of the pedal proximal to the fixed base being linked to the movable element by a link element;

at least one positioning element, hung at the base board and longitudinally movable, and a second stop portion being formed at a corresponding position of each support frame and having a longitudinal height greater than the thickness of the base board; and at least one positioning element, being drooped when the base board stays in air, and the first stop portion being swung downwardly with the support frame and across the second stop portion from the base board into an internal side of the base board, and each second stop portion being propped out from the base board to block the first stop portion in an upward swinging direction of the support frame when the base board is placed on a ground.

DETAILED DESCRIPTION OF THE PREFERRED EMBODIMENTS

The technical content of the present invention will become apparent with the detailed description of preferred embodiments and the illustration of related drawings as follows. It is noteworthy that same numerals used in the following preferred embodiments and related drawings represent respective elements of the invention.

With reference to FIGS. 1 to 7 for preferred embodiments of the present invention respectively, the embodiments are provided for the purpose of illustrating the present invention, but not intended for limiting the scope of the invention.

In this preferred embodiment, a foldable musical instrument pedal device is disclosed, and the musical instrument comprises a fixed element and a movable element, and the pedal device is linked to the movable element for hitting the fixed element such as a HI-HAT cymbal, and an upper cymbal mounted onto a cymbal stand is a movable element coupled to the pedal device, and a lower cymbal is the fixed element. For example, a beater of a bass drum pedal is a movable element coupled to the pedal device, and a bass drum is a fixed element.

Figure 1:
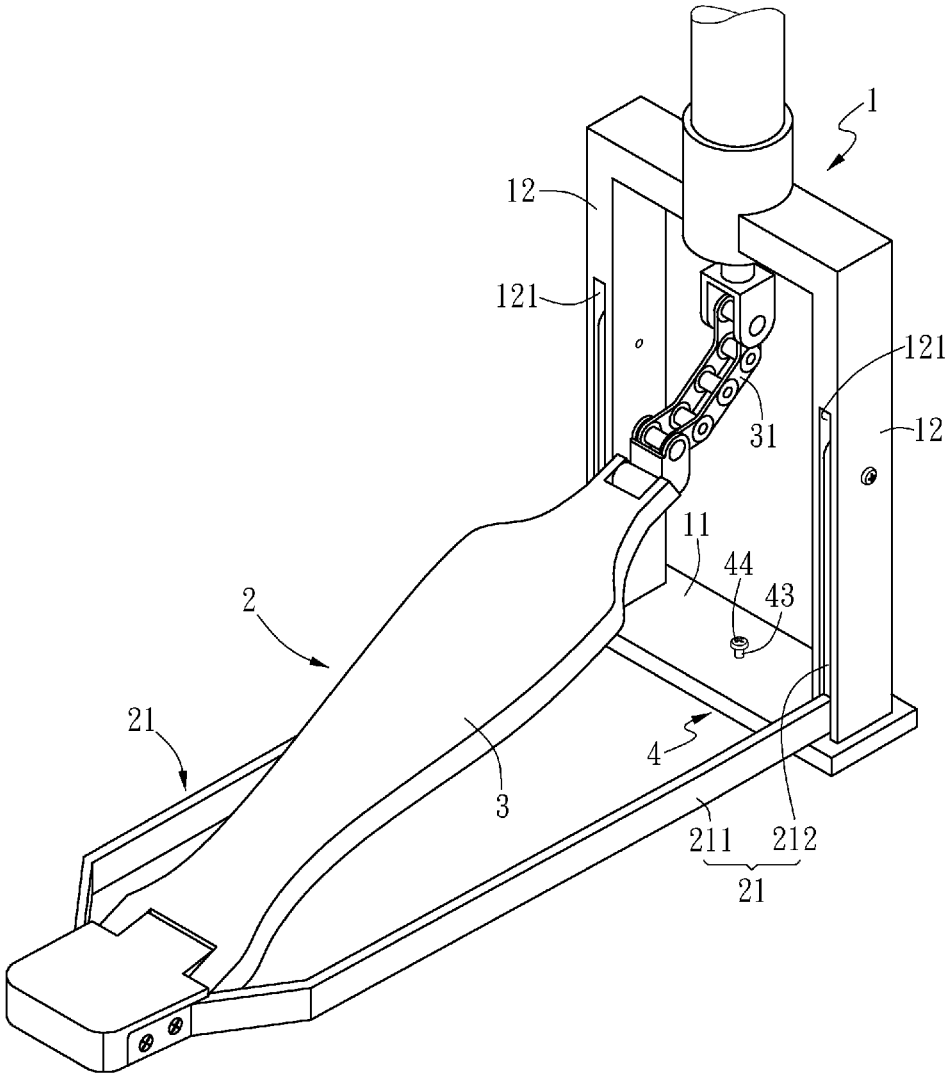
FIG. 1 is a perspective view of a first preferred embodiment of the present invention.

With reference to FIG. 1 for a musical instrument of this preferred embodiment which is a HI-HAT cymbal, the pedal device comprises a fixed base 1, a pedal base 2, a pedal 3 and a positioning element 4.

Figure 2:
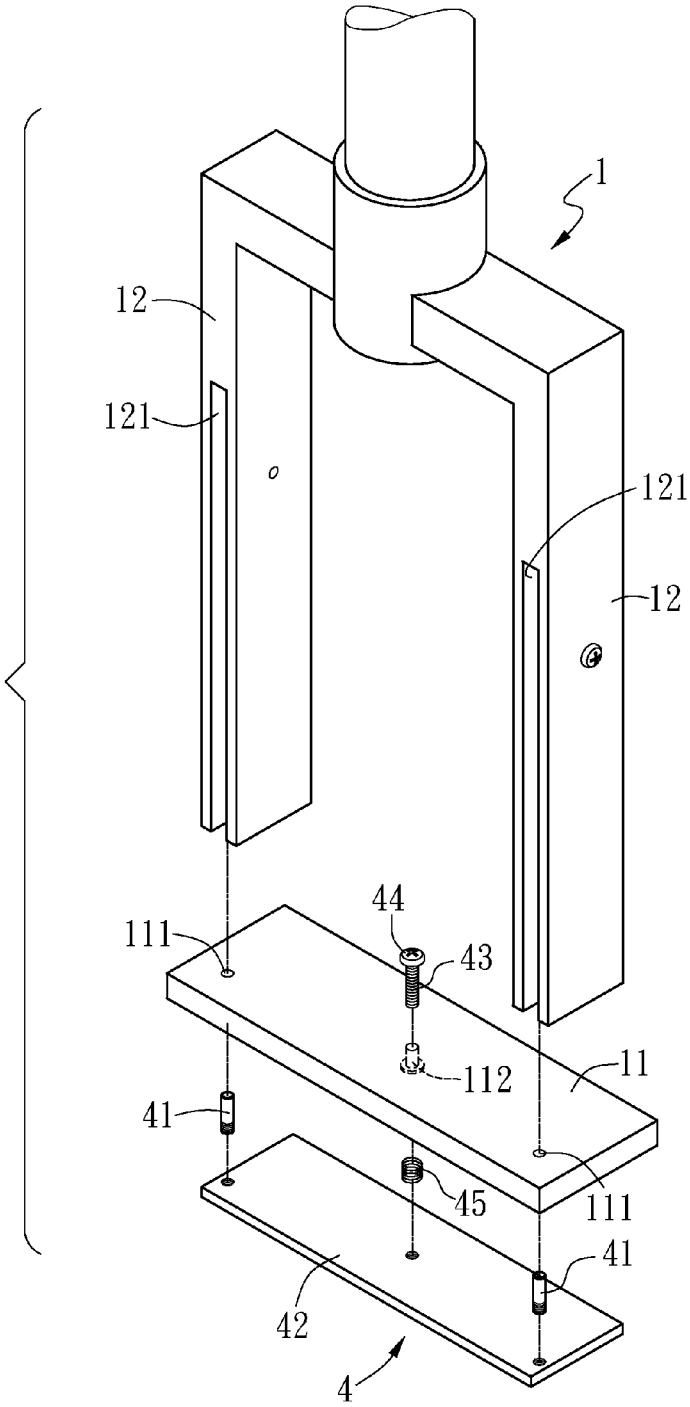
FIG. 2 is a perspective view, showing the layout of a fixed base and a positioning element of the first preferred embodiment of the present invention.

In FIGS. 1 and 2, the fixed base 1 has a base board 11 transversally disposed at the bottom of the fixed base 1, and the fixed base 1 has two upright pillars 12 fixed to both sides of the base board 11 respectively.

Figure 3:
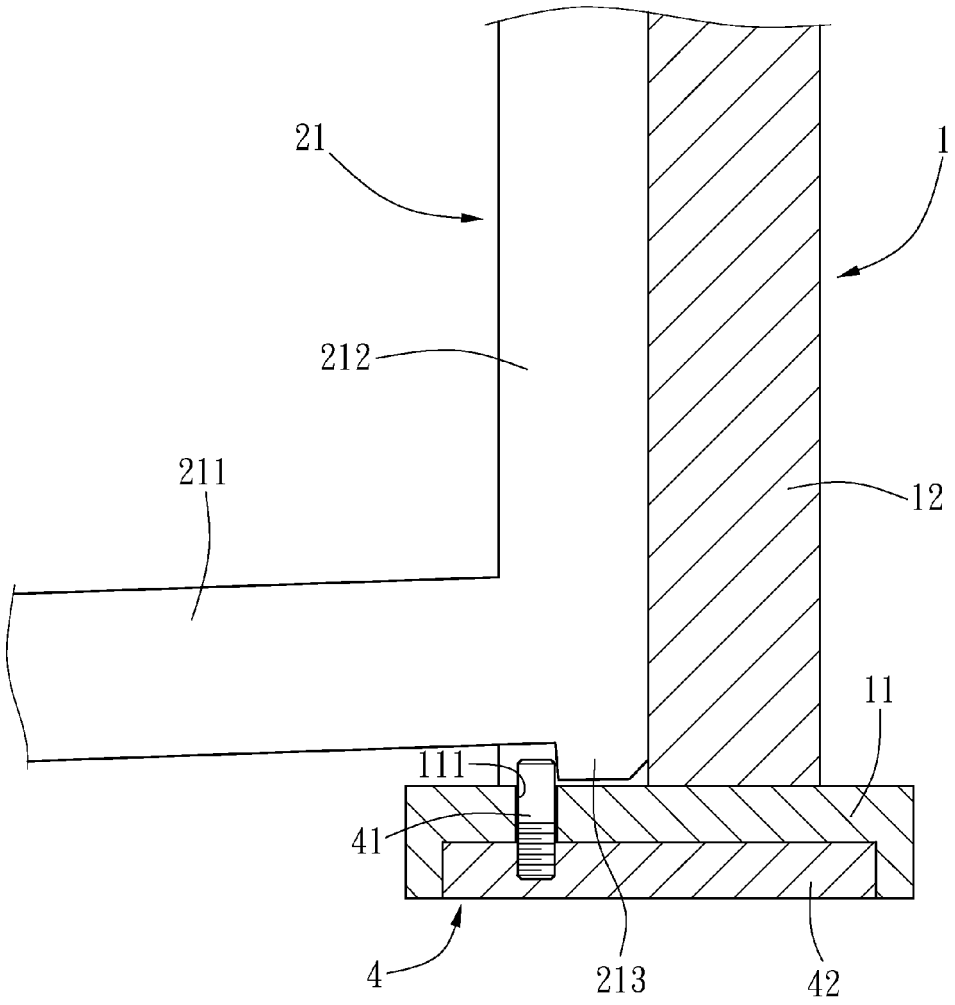
FIG. 3 is a partial cross-sectional view of a positioning element attached onto a base board of the first preferred embodiment of the present invention.

In FIGS. 1 and 3, the pedal base 2 has two support frames 21 corresponding to the two upright pillars 12, and each support frame 21 has a horizontal section 211 and a vertical section 212, and the horizontal section 211 has a substantially equal height of the base board 11, and the vertical section 212 is formed by bending an end of the horizontal section perpendicularly, and an top end of the vertical section 212 at a height position is directly and pivotally coupled to the corresponding upright pillar 12, and the support frame 21 has a first stop portion 213 formed at a bent corner of the horizontal section 211 and the vertical section 212.

In FIG. 1, the pedal 3 is installed between the two support frames 21, and an end of the pedal 3 away from the fixed base 1 is pivotally installed to the pedal base 2, and an end of the pedal 3 near the fixed base 1 is coupled to an upper cymbal on a cymbal stand by a link element 31 to control the beating of a lower cymbal.

In FIGS. 1 to 3, the positioning element 4 is hung at the base board 11 and moved longitudinally, and each support frame 21 has a second stop portion 41 formed at a corresponding position, and each second stop portion 41 has a longitudinal height greater than the thickness of the base board 11.

Figure 4:
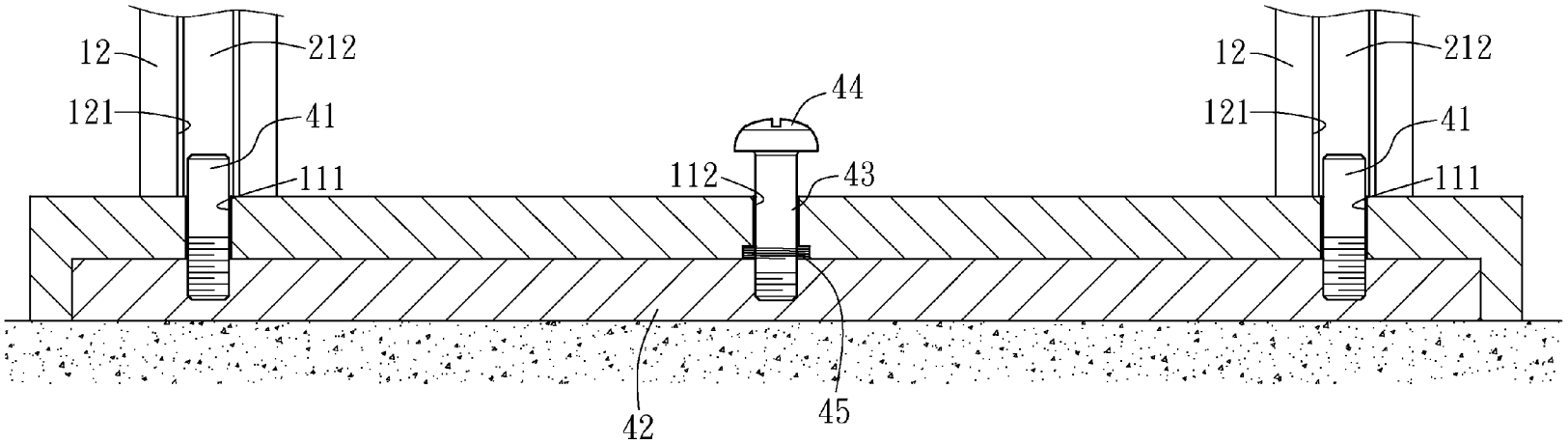
FIG. 4 is a partial front cross-sectional view of a positioning element attached onto a base board of the first preferred embodiment of the present invention.

In FIGS. 2 to 4, the positioning element 4 of this preferred embodiment has a bottom board 42, and the two second stop portions 41 are stop columns disposed on both sides of bottom board 42 respectively, and the bottom board 42 has a hanging rod 43 installed between the two second stop portions 41. The two upright pillars 12 have a slot 121 concavely formed on a side facing the pedal 3 and provided for swinging the vertical section 212 of the support frame 21 into the slot 121, and the base board 11 has a first through hole 111 formed at the bottom in each slot 121 and provided for passing the second stop portion 41 out from the slot 121. The base board 11 has a second through hole 112 formed between the two first through holes 111 and provided for passing the hanging rod 43 out, and a stop head 44 is formed at a top end of the hanging rod 43 for limiting a longitudinal movement of the hanging rod 43 in the second through hole 112. A compression spring 45 is sheathed on the hanging rod 43 and installed between the bottom board 42 and the base board 1, and the first stop portion 213 is a stop block corresponding to the second stop portion 41 and protruded downwardly towards the horizontal section 211.

Figure 5:
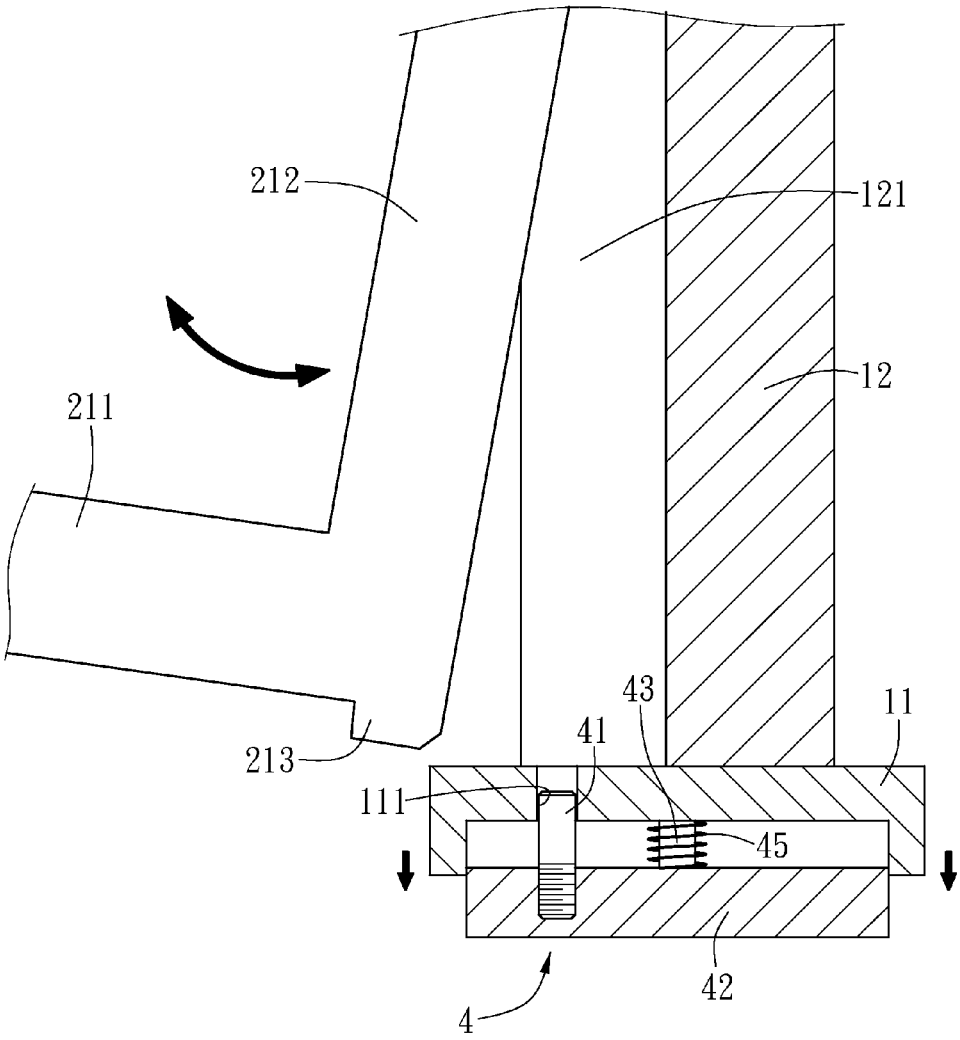
FIG. 5 is a partial side cross-sectional view of a positioning element drooped with respect to a base board of the first preferred embodiment of the present invention.
Figure 6:
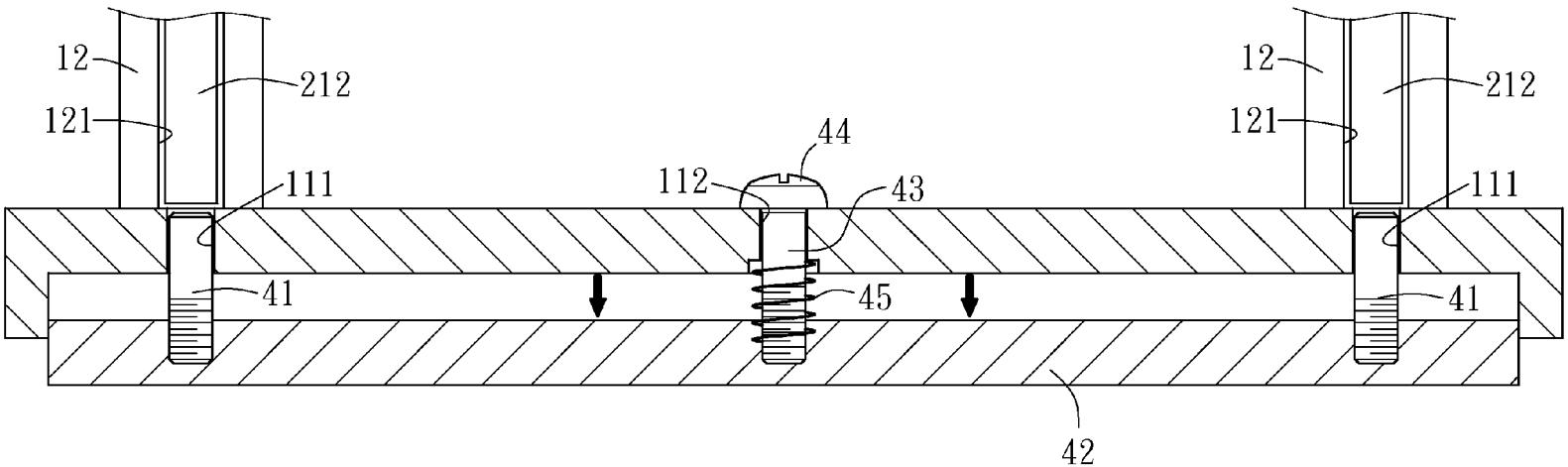
FIG. 6 is a partial front cross-sectional view of a positioning element drooped with respect to a base board of the first preferred embodiment of the present invention.
Figure 7:
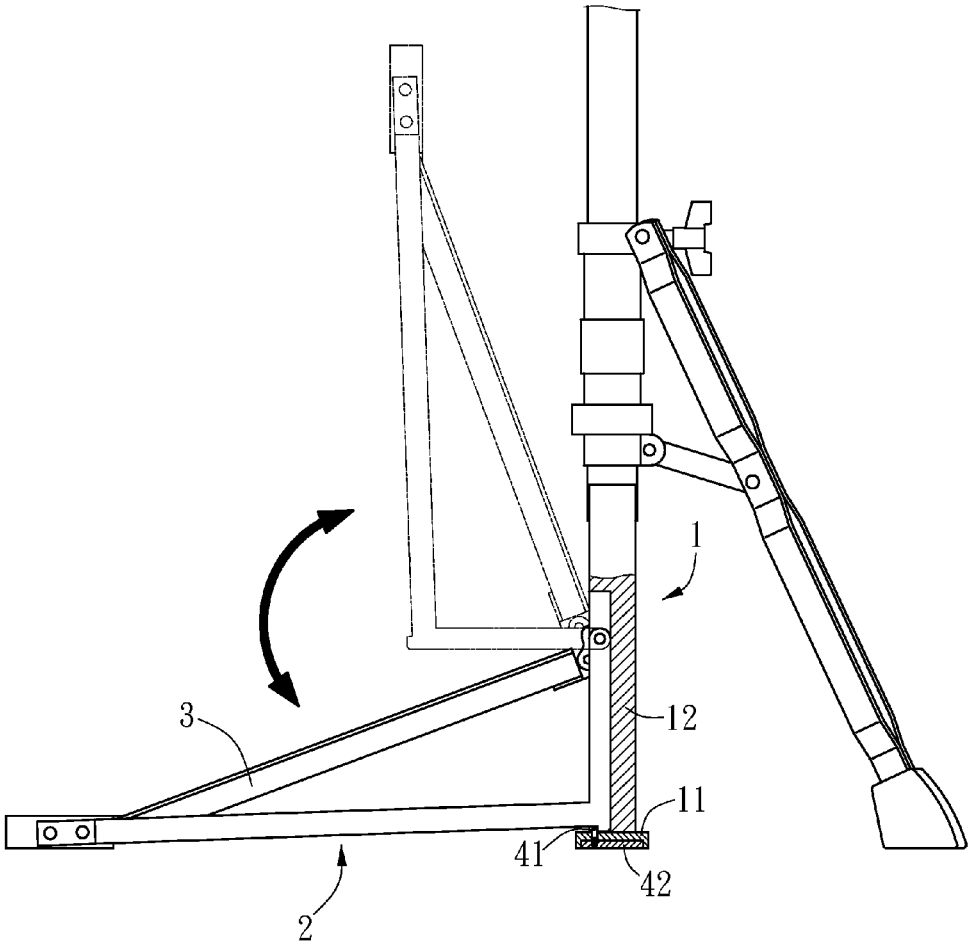
FIG. 7 is a schematic view of folding a pedal together with a pedal base of the first preferred embodiment of the present invention.

In FIGS. 5 and 6, when the base board 11 stays in air, the bottom board 42 of the positioning element 4 is pushed to droop by the gravitational force of the bottom board and the assistance of the compression spring 45, and the stop head 44 disposed at the top end of the hanging rod 43 blocks the bottom board 42 to keep the bottom board 42 to be hung. Now, the second stop portion 41 at the bottom of the slot 121 droops and moves downwardly with the bottom board 42, such that the vertical section 212 of the support frame 21 is swung into the slot 121 as shown in FIG. 7, and the first stop portion 213 swings downwardly with the support frame 21 and across the second stop portion 41 from an external side of the base board 11 to an internal side of the base board 11. When the base board 11 is placed on a ground, the status as shown in FIG. 3 is resumed. Each second stop portion 41 is propped out from the base board 11 and extended out from the bottom of the slot 121 to block the first stop portion 213 in an upward swinging direction of the support frame 21. In other words, the second stop portion 41 at the bottom of the slot 121 is provided for blocking the first stop portion 213 in the slot 121 to position the pedal 3 at a downward swinging status.

In view of the description above, the present invention has the following advantages. The positioning element 4 combined to the base board 11 is adopted, and the base board 11 keeps the positioning element 4 to be drooped as the fixed base 1 stays in air. When the base board 11 is placed on a ground, the bottom board 42 of the positioning element 4 is attached onto the base board 11. Now, the second stop portion 41 is moved vertically up and down with the bottom board 42 to constitute a blocking of the first stop portion 213. Compared with a conventional musical instrument pedal, the musical instrument pedal of the present invention uses the second stop portion 41 to block the first stop portion 213, so that the blocking relation between the first stop portion 213 and the second stop portion 41 is not affected, even though the pedal 3 is stepped frequently. Therefore, there is no longer any issue of loosening the fixed base 1 from the pedal base 2. In addition, the present invention comes with a simple structure and thus lowering the manufacturing cost.

Figure 8:
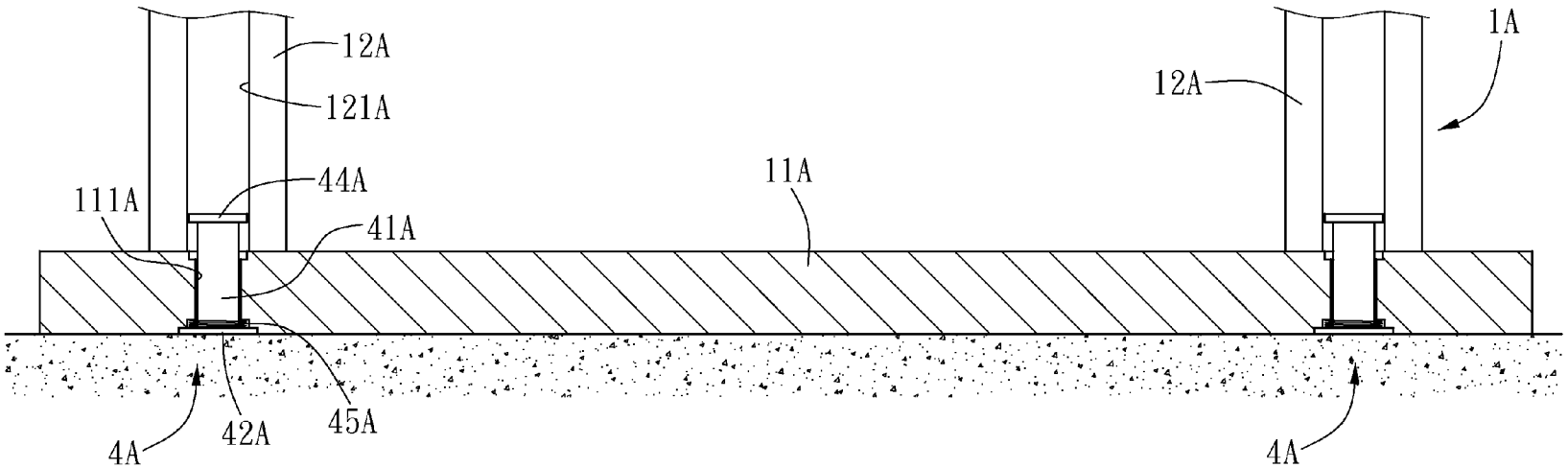
FIG. 8 is a partial front cross-sectional view of a positioning element attached onto a base board of a second preferred embodiment of the present invention.
Figure 9:
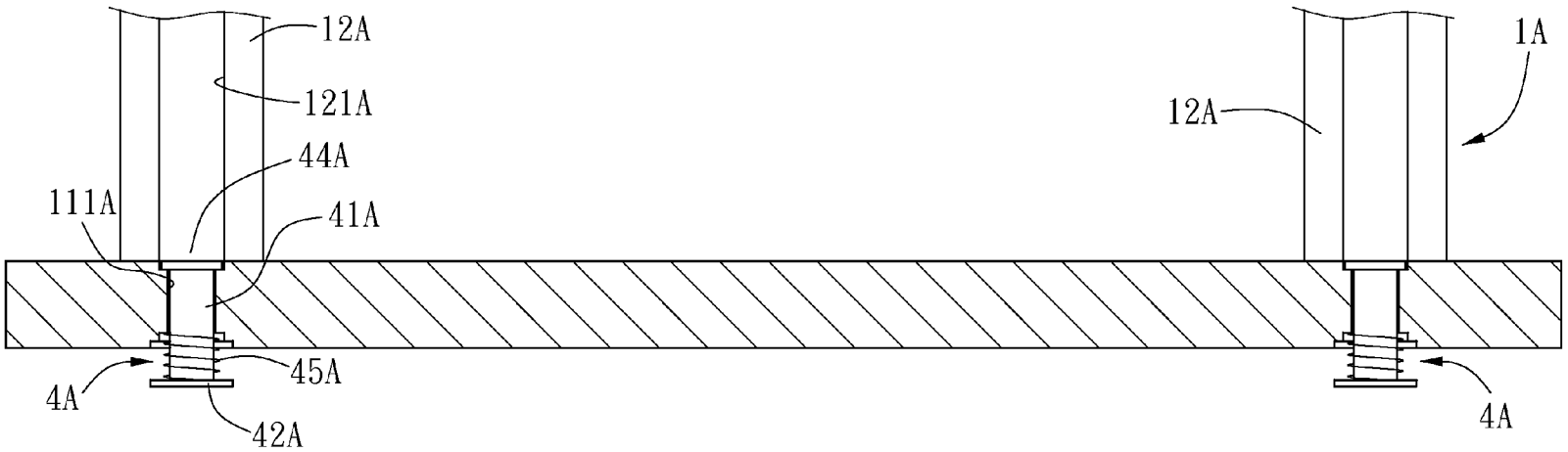
FIG. 9 is a partial front cross-sectional view of a positioning element drooped with respect to a base board of the second preferred embodiment of the present invention.

Of course, there are other examples of the present invention with minor modifications or changes. With reference to FIGS. 8 and 9 for the second preferred embodiment of the present invention, the main difference of this preferred embodiment from the first preferred embodiment resides on that the two positioning elements 4A of this preferred embodiment are independent components, and both having a second stop portion 41A which is a stop column with the function similar to that of the hanging rod of the first preferred embodiment, and the two upright pillars 12A of the fixed base 1A have a slot 121A separately and concavely formed on a side of a pedal (not shown in the figure) similar to the first preferred embodiment, and the base board 11A of the fixed base 1A has a through hole 111A formed at the bottom of each slot 121A for passing the second stop portion 41A out from the slot 121A, and the bottom of each second stop portion 41A has an external diameter greater than a bottom disk 42A of the through hole 111A, and a stop head 44A is formed at the top for limiting a longitudinal movement of the second stop portion 41A in the through hole 111A, and a compression spring 45A is sheathed on the second stop portion 41A and installed between the bottom disk 31A and the base board 11A, so as to achieve the same effect of the first preferred embodiment.

Figure 10:
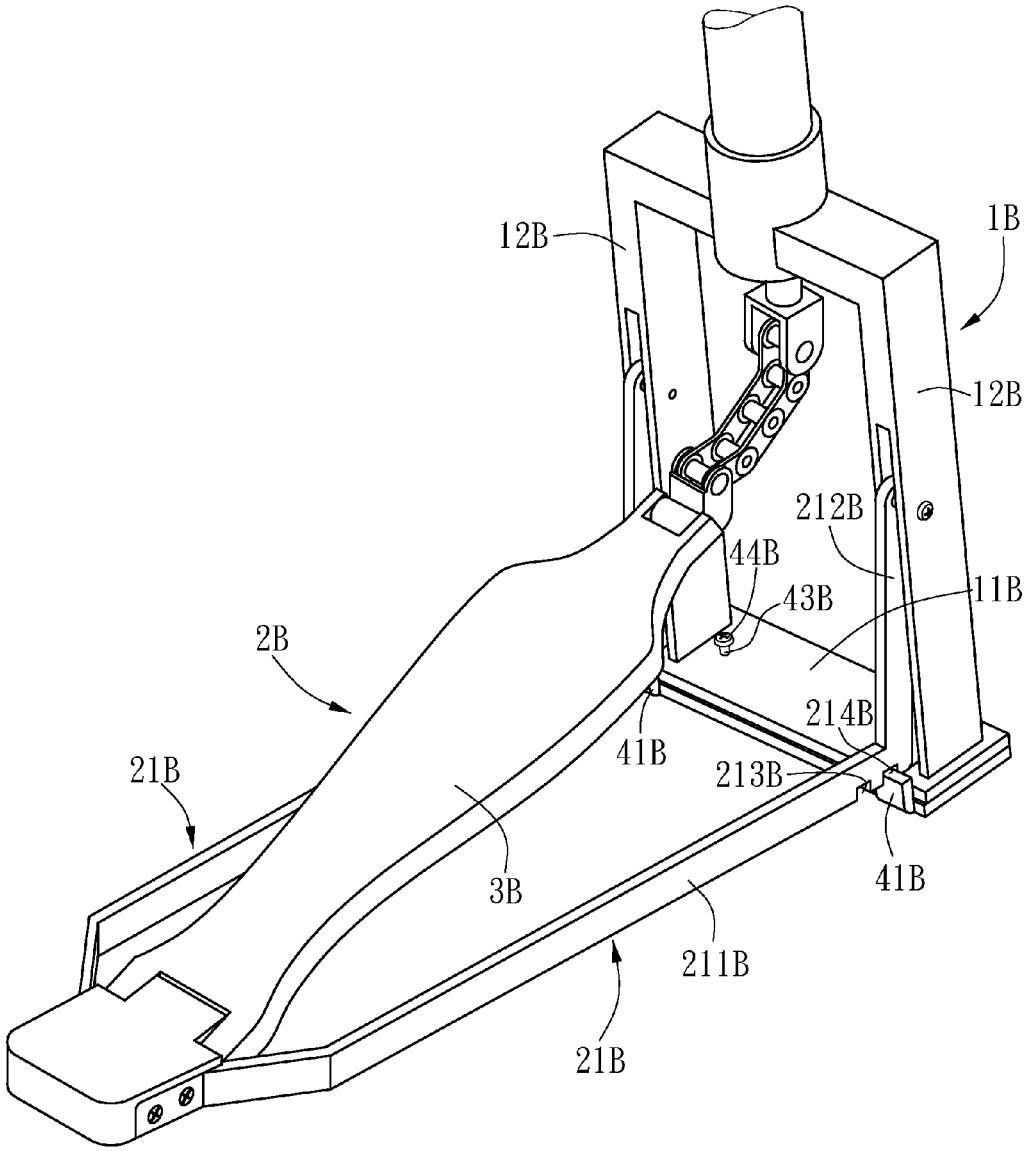
FIG. 10 is a perspective view of a third preferred embodiment of the present invention.
Figure 11:
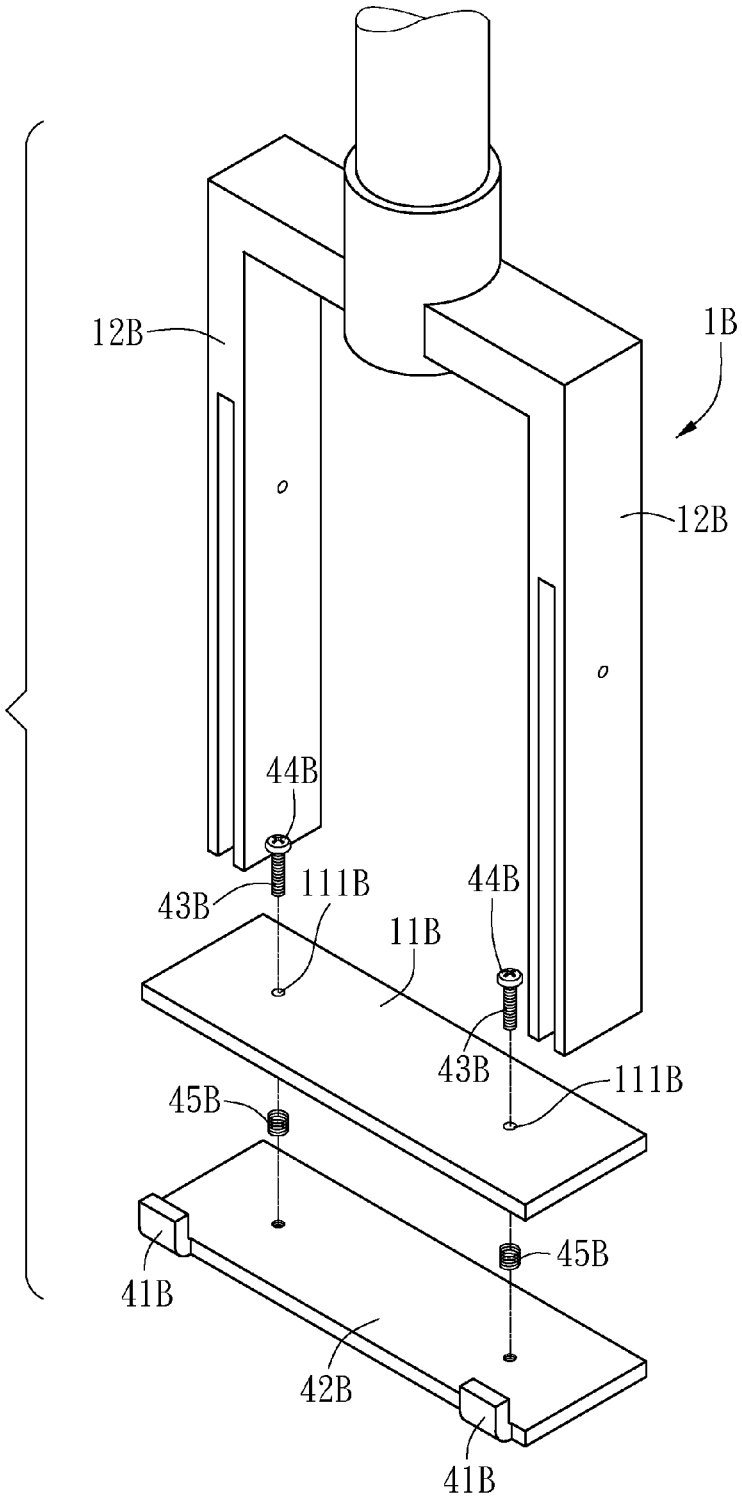
FIG. 11 is a perspective view, showing the layout of a fixed base and a positioning element of the third preferred embodiment of the present invention.

With reference to FIGS. 10 and 11 for the third preferred embodiment of the present invention, the third preferred embodiment comprises a fixed base 1B, a pedal base 2B and a pedal 3B, and a positioning element 4B, wherein the pedal base 2B and pedal 3B are the same as those of the first preferred embodiment, and this preferred embodiment is similar to the first preferred embodiment that only uses one positioning element. However, the main difference resides on that the positioning element 4B of this preferred embodiment has a bottom board 42B, and the two second stop portions 41B are baffles with both opposite sides disposed on the bottom board 42B and proximate to the sides of the pedal 3B and keeping an interval apart from the upright pillar 12B of the fixed base 1B, and the bottom board 42B has two hanging rods 43B installed on both sides of the bottom board 42B and near each second stop portion 41B, and two through holes 111B are formed on both sides of the base board 11B for passing the two hanging rods 43B out from the two through holes 111B respectively, and a stop head 44B is disposed at a top end of each hanging rod 43B for limiting a longitudinal movement of the hanging rod 43B in the through hole 111B, and a compression spring 45B is sheathed on the hanging rod 43B and installed between the bottom board 42B and the base board 11B.

Figure 12:
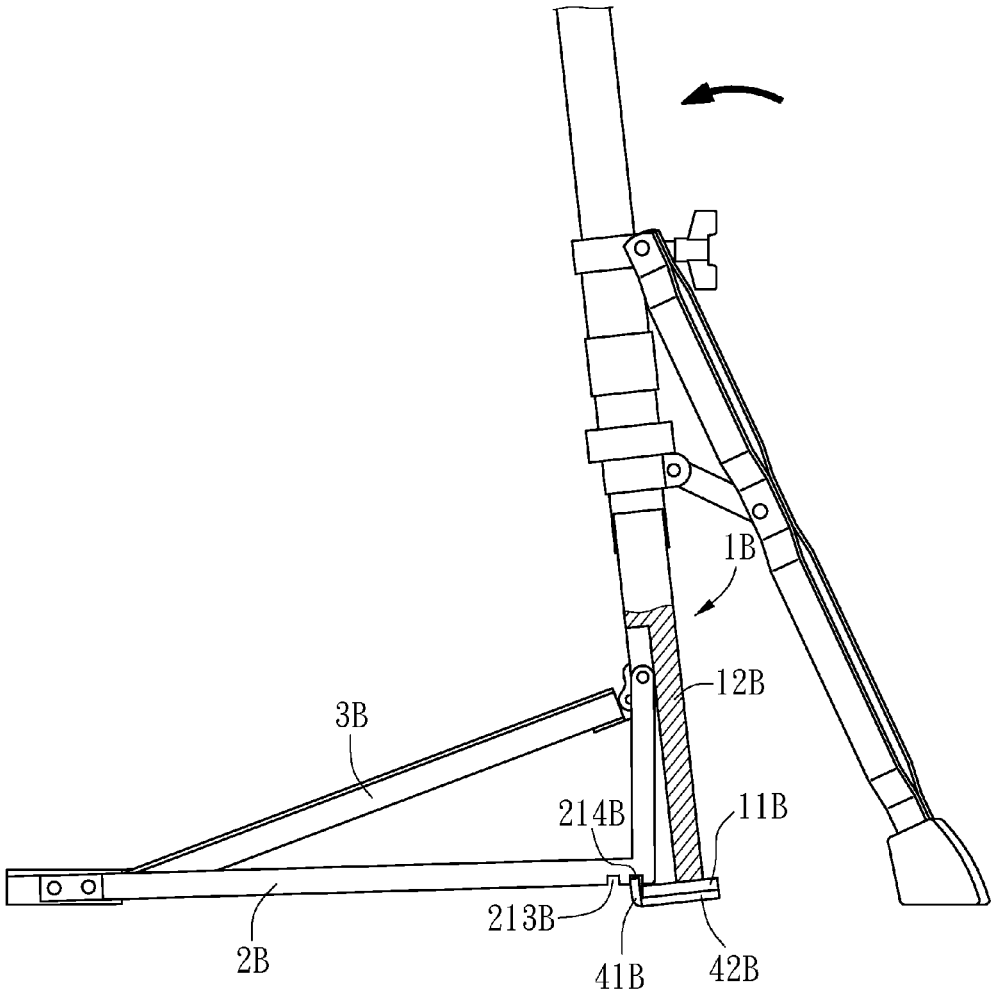
FIG. 12 is a schematic view showing a slightly tilted status of a fixed base with respect to a pedal base of the third preferred embodiment of the present invention.
Figure 13:
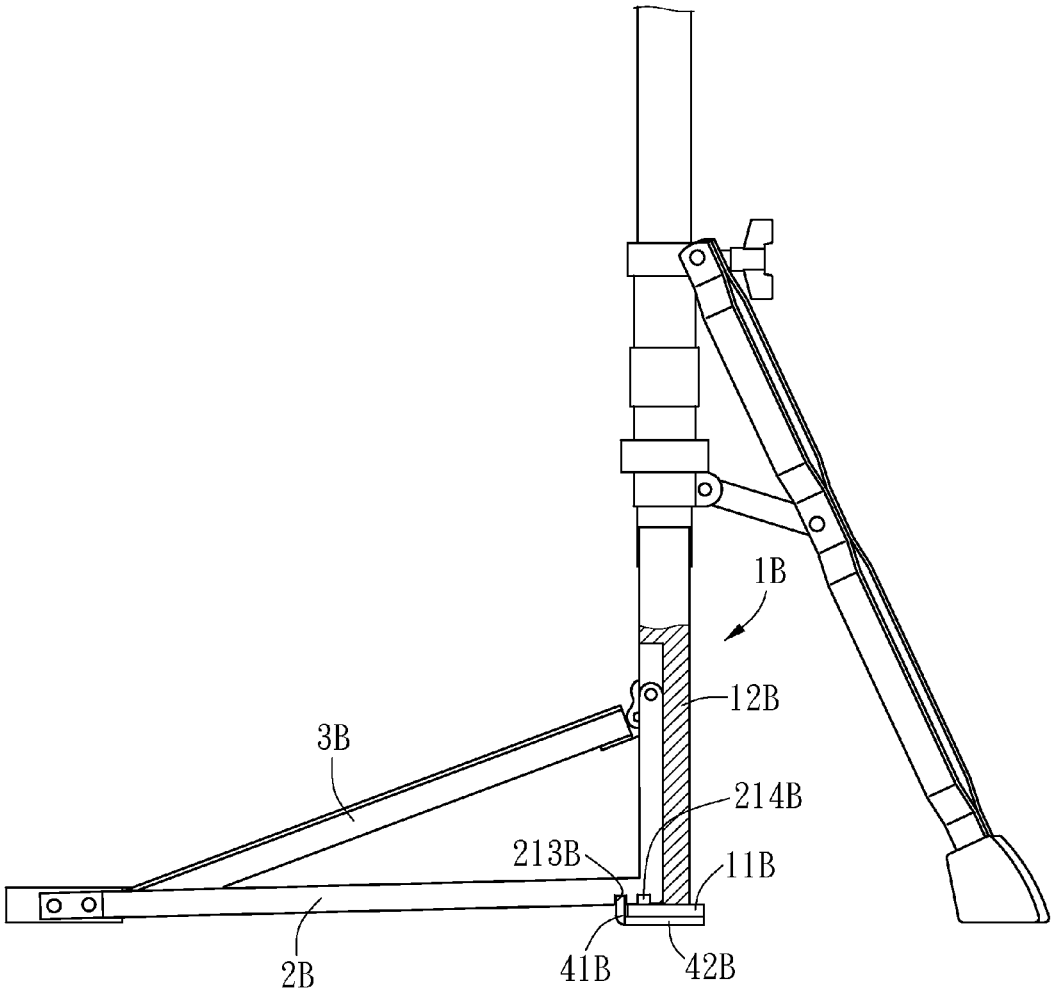
FIG. 13 is a schematic view showing an upright status of a fixed base with respect to a pedal base of the third preferred embodiment of the present invention.

In this preferred embodiment, two first stop portions 213B, 214B are formed at a bent corner of the horizontal section 211B and the vertical section 212B of the support frame 21B, and the two first stop portions 213B, 214B are arranged sequentially at the front and the rear, and both of the first stop portions 213B, 214B are notches corresponding to the second stop portion 41B and concavely formed towards the horizontal section 211B, and the fixed base 1B has the same effect of the first preferred embodiment according to the blocking relation of the first stop portion 213B or 214B with the second stop portion 41B, and the inclined angle of the fixed base 1B can be changed. In FIG. 12, the first stop portion 214B and the second stop portion 41B block each other and are tilted with the fixed base 1B. Now, the cymbal stand can be slightly tilted towards a user. In FIG. 13, the first stop portion 213B and the second stop portion 41B block each other. Now, the cymbal stand is erected, so as to achieve the effect of adjusting the inclined angle.

What is claimed is:

1. A foldable musical instrument pedal device, and a musical instrument including a fixed element and a movable element, and the pedal device being linked to the movable element for hitting the fixed element, comprising:

a fixed base, having a base board transversally disposed at the bottom of the fixed base, and two upright pillars fixed on both sides of the base board respectively;

a pedal base, having two support frames corresponding to the two upright pillars, and each support frame having a horizontal section with a substantially equal height with the base board, and a vertical section formed by perpendicularly bending an end of the horizontal section, and a top end of the vertical section at a height position being directly and pivotally installed at the corresponding upright pillar, and at least one first stop portion being disposed at a bent corner of the horizontal section and the vertical section;

a pedal, installed between the two support frames, and an end of the pedal away from the fixed base being pivotally installed to the pedal base, and an end of the pedal proximal to the fixed base being linked to the movable element by a link element; and at least one positioning element, hung at the base board and longitudinally movable, and a second stop portion being formed at a corresponding position of each support frame and having a longitudinal height greater than the thickness of the base board;

at least one positioning element, being drooped when the base board stays in air, and the first stop portion being swung downwardly with the support frame and across the second stop portion from the base board into an internal side of the base board, and each second stop portion being propped out from the base board to block the first stop portion in an upward swinging direction of the support frame when the base board is placed on a ground.

2. The foldable musical instrument pedal device of claim 1, wherein only one positioning element is included, and the positioning element has a bottom board, and the two second stop portions are stop columns installed on both sides of the bottom board respectively, and a hanging rod is installed on the bottom board and between the two second stop portions, and the two upright pillars have a slot separately and concavely formed on a side facing the pedal for swinging the vertical section of the support frame into the slot, and the base board has a first through hole formed at the bottom of each slot for passing the second stop portion into the slot, and the base board has a second through hole formed between the two first through holes for passing the hanging rod out from the second through hole, and a stop head is disposed at a top end of the hanging rod for limiting a longitudinal movement of the hanging rod in the second through hole, and a compression spring is sheathed on the hanging rod and installed between the bottom board and the base board, and the first stop portion is a stop block corresponding to the second stop portion and protruded downwardly towards the horizontal section.

3. The foldable musical instrument pedal device of claim 1, further comprising two positioning elements, and each positioning element having the second stop portion which is a stop column, and the two upright pillars having a slot separately and concavely formed on a side towards the pedal for swinging the vertical section of the support frame into the slot, and the base board having a through hole formed at the bottom of each slot for passing the second stop portion out from the slot, and each second stop portion having a bottom disk with an external diameter greater than the through hole, and a stop head being disposed at the top for limiting a longitudinal movement of the second stop portion in the through hole, and a compression spring being sheathed on the second stop portion and installed between the bottom disk and the base board.

4. The foldable musical instrument pedal device of claim 1, wherein only one positioning element is included, and the positioning element has a bottom board, the two second stop portions are baffles with both opposite sides disposed at the bottom board and primate to the sides of the pedal and with an interval apart from the upright pillar, and the bottom board has two hanging rods disposed separately at a position near each second stop portion, and two holes are formed on both sides of the base board for passing the two hanging rods out from the through holes respectively, and a stop head is formed at a top end of each hanging rod for limiting a longitudinal movement of the hanging rod in the through hole, and a compression spring is sheathed on the hanging rod and installed between the bottom board and the base board, and the first stop portion is a notch corresponding to the second stop portion and concavely formed towards the horizontal section.

5. The foldable musical instrument pedal device of claim 4, further comprising two or more first stop portion arranged sequentially from the front to the rear and separately formed at a bent corner of the horizontal section and the vertical section, and the fixed base changing its inclined angle according to different blockings of the first stop portion and the second stop portion with each other.

* * * * *